United States Patent [19]

Katsumata

[11] 3,998,197

[45] * Dec. 21, 1976

[54] SIGNAL SOURCE FOR USE IN A BREAKERLESS IGNITION SYSTEM FOR AN INTERNAL COMBUSTION ENGINE

[75] Inventor: Mitsuo Katsumata, Numazu, Japan

[73] Assignee: Kokusan Denki Co., Ltd., Numazu, Japan

[ * ] Notice: The portion of the term of this patent subsequent to Sept. 9, 1992, has been disclaimed.

[22] Filed: Nov. 1, 1974

[21] Appl. No.: 520,140

[30] Foreign Application Priority Data

Feb. 11, 1973 Japan ..... 48-127514[U]

[52] U.S. Cl. ..... 123/148 CC; 310/70 R; 310/153

[51] Int. Cl.[2] ..... F02P 1/00

[58] Field of Search ..... 310/70, 153, 75, 168, 310/169, 170, 155; 123/149, 148 A, 149 C, 149 D, 148 E, 148 CC, 148 F; 322/91; 74/572

[56] References Cited

UNITED STATES PATENTS

| | | | |
|---|---|---|---|
| 2,753,490 | 7/1956 | Smits | 310/153 |
| 3,619,634 | 11/1971 | Burson | 310/153 |
| 3,720,195 | 3/1973 | Fujii | 310/153 |
| 3,732,483 | 5/1973 | Katsumata | 310/70 |
| 3,741,186 | 6/1973 | Doi | 123/149 D |
| 3,746,901 | 7/1973 | Berg | 310/70 |
| 3,747,582 | 7/1973 | Kato | 123/149 D |
| 3,775,627 | 11/1973 | Nagasawa | 322/91 |
| 3,783,315 | 1/1974 | Takahashi | 310/153 |

*Primary Examiner*—R. Skudy
*Attorney, Agent, or Firm*—Watson Leavenworth Kelton & Taggart

[57] ABSTRACT

A signal source for use in a breakerless ignition system for an internal combustion engine provided outside a bowl-like flywheel of a flywheel type magneto generator, but cooperating with at least one of a plurality of permanent magnets in said magneto generator. The signal generator comprises timing pole means with one end thereof connected to a pole piece of the permanent magnet and with the other end radially extending through and exposed exterior of the cylindrical wall of the bowl-like flywheel in a spaced relationship from the magnet and signal coil means disposed closely adjacent to and outside of said bowl-like flywheel so that said coil means is interlinked with magnetic flux through said timing pole means.

5 Claims, 5 Drawing Figures

SIGNAL SOURCE FOR USE IN A BREAKERLESS IGNITION SYSTEM FOR AN INTERNAL COMBUSTION ENGINE

BACKGROUND OF THE INVENTION

A breakerless ignition system for an internal combustion engine is well known which comprises a semiconductor switching element, such as a thyristor disposed in a primary circuit of an ignition coil for controlling a primary current through the ignition coil by opening or closing the switching element in time with ignition point of the engine. A capacitor discharge type ignition system is typically employed. Such ignition system is provided with a signal source supplying a control signal to the semiconductor switching element in synchronism with rotation of the engine. In general, the signal source comprises a signal coil or coils disposed within a magneto generator in cooperation with magnetic field thereof. However, due to various coils, such as generating coil or coils for charging a capacitor in the capacitor discharge type ignition system and lighting coil or coils disposed within the magneto generator, there is no room in the magneto generator for mounting the signal coil or coils of the signal source. In particular, the breakerless ignition system for a multicylinder internal combustion engine requires a plurality of signals, which causes the signal coil design to be complicated, resulting in that assembly of the flywheel magneto generator is troublesome. In addition, the signal coil or coils disposed within the magneto tend to generate excessive signals as well as control signal during one complete revolution of the magneto generator because the number of the signals is determined by the number of the magnetic poles in the magneto generator. Such excessive signals must be removed out of the ignition circuit.

I have proposed a signal source for use in a breakerless ignition system for an internal combustion engine wherein a signal coil or coils can be mounted on a magneto generator without any interference. This has been disclosed in U.S. patent application Ser. No. 428,716, now U.S. Pat. No. 3,903,863 filed by the same inventor and assigned to the same assignee as those of this application. The signal source disclosed therein comprises a flush bolt securing one of magnets and associated pole piece to a bowl-like flywheel and extending through a hole in the bowl-like flywheel in a magnetically insulated manner from the flywheel and a signal coil disposed exterior of the flywheel and adjacent to the flush bolt and the flywheel so that magnetic flux through the flush bolt may be interlinked with the signal coil. The disadvantage of such signal source is the difficulty for the magnet and the associated pole piece to be installed on the flywheel because the flush bolt must be secured to the flywheel in a magnetically insulated relation therefrom.

OBJECT OF THE INVENTION

Accordingly, it is a principal object of the present invention to provide a signal source for use in a breakerless ignition system for an internal combustion engine wherein magnetically conducting means to conduct magnetic flux from one or more of magnets in a flywheel to a signal coil or coils can be easily arranged without any installation thereof.

SUMMARY OF THE INVENTION

In accordance with the present invention, there is provided a signal source for use in a breakerless ignition system for an internal combustion engine in combination with a flywheel type magneto generator comprising a rotor including a bowl-like flywheel of magnetic material and a plurality of permanent magnets spaced from each other and mounted on the inside surface of said flywheel, said permanent magnets each having a pole piece mounted on the inner face thereof and a stator including at least one generating coil for supplying ignition power to said ignition system, said signal source comprising at least one of said permanent magnets of said rotor; timing pole means of magnetic material with one end thereof connected to one of said pole pieces at the edge and radially extending through and exposed exterior of the cylindrical wall of said bowl-like flywheel in a spaced relationship from said permanent magnet; and signal coil means disposed closely adjacent to said bowl-like flywheel and said timing pole means and outside said bowl-like flywheel so that said signal coil means is interlinked with magnetic flux through said timing pole means. The signal coil means may comprise a signal coil or coils each having a U-shaped magnetic core around which the coil is wound and may be mounted on either a stator base or a flywheel cover so that both ends of the core are located in a closely spaced relationship from the periphery of the flywheel. Rotation of the flywheel effected by operation of the engine, causes the magnetic core or cores of the signal coil means to bridge the exposed end of the timing pole means and the periphery of the flywheel thereacross for each revolution of the flywheel so that the signal coil or coils have magnetic flux through the corresponding core or cores interlinked therewith to generate an electric signal or signals therefrom in time with rotation of the engine.

Timing pole means may comprise a plurality of timing pole members and they each extend from one of the selected ones of the permanent magnets in the rotor of the magneto generator. Thus, the signal source can generate any selected number of electric signals therefrom for each revolution of the flywheel type magneto generator.

It will be understood from the foregoing that the present invention can be designed so that any required number of electric signals are generated from the signal source independently of the number of the poles of the flywheel rotor and that disposition of the signal coil means outside the flywheel allows it to be arbitrarily positioned without any restriction from a space, in the same manner as described in the my pending U.S. application Ser. No. 428,716 now, U.S. Pat. No. 3,903,863. Furthermore, the present invention facilitates assembly of the signal source because the timing pole means is not required to secure the permanent magnet or magnets and the associated pole piece or pieces to the flywheel in a magnetically insulated relationship therefrom, which is required in the above-mentioned pending application.

BRIEF DESCRIPTION OF THE DRAWING

The above and other objects and features of the present invention will be apparent from the following description of the preferred embodiments taken with reference to the accompanying drawing in which.

DETAILED DESCRIPTION OF THE PREFERRED EMBODIMENTS

Figure 1:
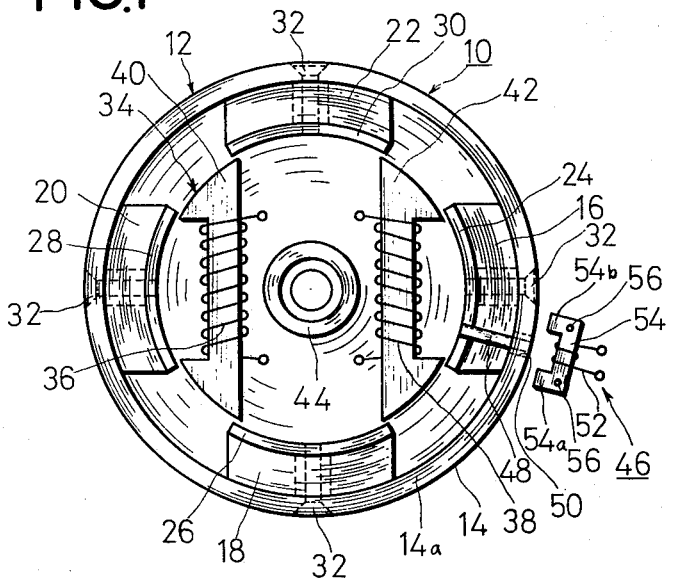
FIG. 1 is a front view of a flywheel type magneto generator having a signal source constructed in accordance with the present invention.
Figure 2:
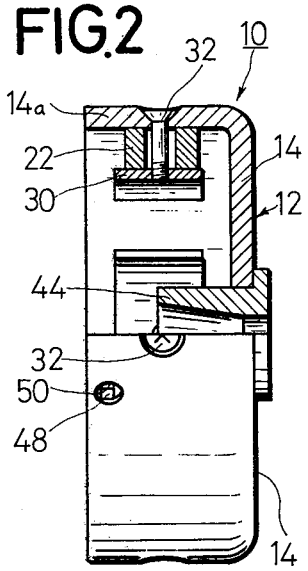
FIG. 2 is a side elevational view of the signal source of FIG. 1 with a stator omitted for illustration and with an upper half portion taken in vertical section.

Referring now to FIG. 1, there is shown a flywheel type magneto generator in use for a breakerless ignition system for an internal combustion engine, provided with a signal source of the present invention. The ignition system may be of capacitor discharge type, for example. The magneto generator is generally indicated by numeral 10 in FIG. 1, and comprises flywheel magnet rotor 12 including a bowl-like flywheel 14 of magnetic material and a plurality of permanent magnets 16 to 22 which are alternately magnetized in opposite directions and securedly mounted on the inside surface of the cylindrical wall 14*a* of the flywheel 14 in an equally and angularly spaced relationship of one to the adjacent one of the magnets. The permanent magnets are provided with respective pole pieces 24 to 30 of magnetic material secured to the respective magnets 14 to 22 at the inner face thereof in a conventional manner. As shown in FIGS. 1 and 2 means to secure the pole pieces and the associated magnets to the flywheel 14 may comprise flush bolts 32 of non-magnetic material extending through the cylindrical wall of the flywheel 14 and the respective magnets 16 to 22 and threadedly engaging the respective pole pieces 24 to 30. The pole pieces 24 to 30 may be additionally bonded to the associated magnets 16 to 22 by means of adhesives.

The magneto generator 10 also comprises a stator 34 including two generating coils 36 and 38 wound around respective I-shaped magnetic cores 40 and 42 which are disposed within the flywheel 12 and secured to a stator base (not shown) in a conventional manner, which base is in turn securedly mounted on or integral with a crank case also not shown. The generating coils 36 and 38 and therefore, the magnetic cores 40 and 42 are arranged in a spaced relationship to each other by the angle of 180° and so that the poles of the cores 40 and 42 are closely spaced from the pole pieces 24 through 30 of the rotor 12. As well known, these generating coils are adapted to charge a capacitor in the capacitor discharge type breakerless ignition system and to energize lighting devices, respectively.

The flywheel 14 may be provided with a hub 44 fitted into and secured to the disc portion 14*b* of the flywheel by means of bolts (not shown) and an engine shaft or a crank shaft (not shown) extends through and is secured to the hub by any suitable means, such as a tightening nut threadedly engaging the threaded portion of the shaft. Thus, the magneto generator rotates in time with rotation of the engine.

Figure 3:
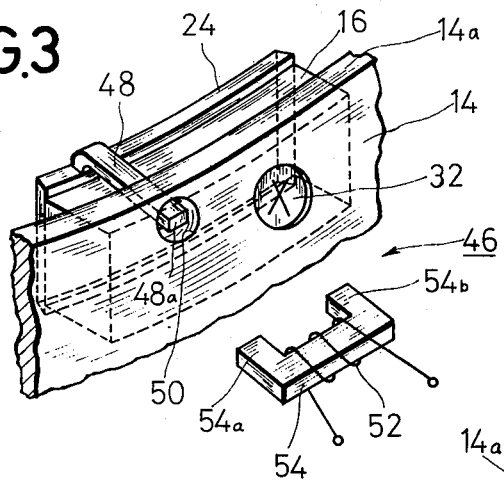
FIG. 3 is a fragmentary and enlarged perspective view of the flywheel with one of the magnetic field means shown and with one embodiment of the signal source of the present invention.

A signal source of the present invention is generally indicated by numeral 46 and comprises a timing pole member 48 of magnetic material having one end connected to the edge of one of the pole pieces which is indicated by numeral 24. In the illustrated embodiment, the timing pole member may be preferably integral with the pole piece 24. This can be accomplished by blanking or punching a metal sheet of magnetic material so as to obtain a substantially rectangular piece with an elongated portion extending from one of the edges of the piece and bending the elongated portion in a substantially right-angular manner as shown in FIG. 3. Alternatively, the timing pole member 48 may be welded to the edge of the pole piece 24. As shown in FIG. 3, the timing pole member $48_1$ extends over the permanent magnet 16 in a spaced manner therefrom and outwardly and radially of the flywheel 14. The cylindrical wall of the flywheel 14 is provided with a hole 50 and the timing pole member $48_1$ at the end extends through the hole in the flywheel 14 in a spaced relationship from the hole wall of the flywheel with the end exposed exterior of the flywheel, but flush with the outer periphery of the flywheel. Thus, magnetic flux from one of the poles of the magnet 16 conducts through the timing pole member $48_1$ and comes out of the flywheel. It will be understood that the permanent magnet 16 is a part of the signal source 46. It will be noted that the space between the hole wall and the timing pole member $48_1$ permits the latter to be magnetically insulated from the flywheel 14. It should be noted that the exposed end 48*a* of the timing pole member $48_1$ is not required to be secured to the flywheel because it does not constitute means to secure the magnet 16 and the pole piece 24 to the flywheel.

The signal source 46 also comprises a signal coil 52 disposed outside and adjacent to the flywheel 14 and wound around a U-shaped magnetic core 54 with two leg portions 54*a* and 54*b* closely spaced from the periphery of the flywheel 14. The signal coil 52 may be mounted by attaching the core 54 to the stator base (not shown) or a flywheel cover (also not shown) by means of setscrews 56 extending through the core 54 and threaded into the base or cover.

The signal source is associated with the capacitor discharge type breakerless ignition system for the internal combustion engine. More particularly, the signal source may be arranged so that it controls the conduction of a semiconductor switching device such as a thyristor for controlling the discharge of the capacitor in the ignition system. The ignition system is not a part of the invention and therefore, it will not be described in further detail hereinafter.

While the flywheel 14 is being driven by the engine, the core leg portions 54*a* and 54*b* of the signal source 46 face the exposed end of the timing pole member 48 for each revolution of the flywheel to complete a magnetic circuit from the timing pole member $48_1$ through the core 54 to the flywheel 14. Thus, when the core 54 at one of the leg portions 54*a* and 54*b* thereof faces the exposed end of the timing pole member $48_1$, magnetic flux flows from one of the poles of the magnet 16 through the timing pole member $48_1$ to the core 54 and then through the flywheel 14 to the other pole of the magnet 16. As a result, the flux is interlinked with the signal coil 52 to produce an electric signal therefrom. The signal which is thus generated in time with rotation of the engine, is available for controlling the semiconductor switching device as above-mentioned. It will be noted that since the flywheel 14 is made from magnetic material, flux will not leak out of the flywheel except for the hole 50 therein and therefore, any false signal will never be generated from the signal coil 52.

Figure 4:
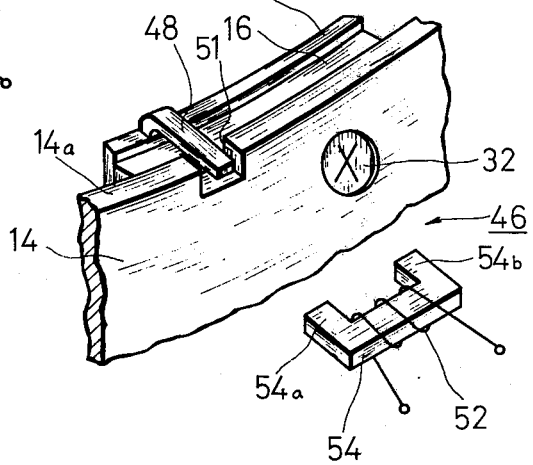
FIG. 4 is substantially similar to FIG. 3, but illustrating another embodiment of the present invention.

FIG. 4 shows another embodiment of the signal source which is substantially identical to that of FIGS. 1 to 3, except for the hole 50 of FIG. 3 replaced by a U-shaped cut away portion 51 provided in the flywheel 14 at the edge of the cylindrical wall thereof. The same components are designated by the same numerals, with the timing pole member being designated $48_2$. The operation of the embodiment of FIG. 4 is identical to that of the foregoing embodiment.

Figure 5:
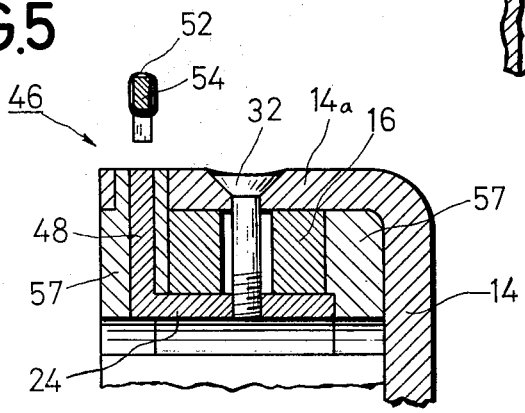
FIG. 5 is an enlarged vertically sectional view of further embodiment of the present invention.

FIG. 5 shows further embodiment of the signal source 46 which is also substantially identical to that of FIGS. 1 to 3, but further comprises non-magnetic moulding 57 provided on the inside periphery of the flywheel 14 so that the magnets 16 to 22 and the timing pole member $48_3$ are imbedded in the moulding with the pole pieces 24 to 30 exposed at the inside periphery of the flywheel 14. The moulding 57 conveniently prevents the timing pole member 48 from subjection to vibration during operation of the engine to thereby improve the physical strength. In the case of the permanent magnets of ferrite, it also serves to prevent the magnets from being cracked.

It will be understood that in case the present invention is applied to the breakerless ignition system for a multicylinder internal engine, the signal source has the corresponding number of signal coils employed therein.

Although some preferred embodiments of the present invention have been illustrated and described with reference to the accompanying drawing, it will be understood that they are by way of example and that various changes and modifications may be made from the teaching of the description without departing from the spirit and scope of the present invention, which is intended to be defined only to the appended claim.

What is claimed is:

1. In a combination of a flywheel magneto generator for a breakerless ignition system for use in an internal combustion engine, said generator comprising a rotor including a bowl-like flywheel of magnetic material, a plurality of permanent magnets spaced from each other and mounted on the inner surface of said flywheel and respective pole pieces mounted on said magnets at the inner faces thereof, and a stator including generating coil means disposed inside said rotor and closely spaced from said pole pieces of said rotor, a signal source comprising at least one of said permanent magnets on said flywheel, timing pole means of magnetic material having one end directly connected to said pole piece on said one permanent magnet and extending from said one end exteriorly of said one permanent magnet to a second end disposed at the outer periphery of said flywheel and magnetically insulated from said flywheel, and signal coil means disposed outside said flywheel and in a closely spaced relationship with said timing pole means second end so that said signal coil means is interlinked through said timing pole means with magnetic flux of said one permanent magnet, said permanent magnets being secured to said flywheel by means other than said timing pole means.

2. A signal source as set forth in claim 1, wherein said timing pole means one end is integrally connected to said pole piece at the edge thereof.

3. A signal source as set forth in claim 1, wherein said flywheel comprises a cylindrical wall provided with a hole and said timing pole means extends through said hole in said flywheel.

4. A signal source as set forth in claim 1, wherein said flywheel comprises a cylindrical wall having an edge provided with a cut away portion and said timing pole means extends through said cut away portion in said flywheel.

5. A signal source as set forth in claim 1, wherein said timing pole means is imbedded in a non-magnetic moulding provided on said flywheel.

* * * * *

UNITED STATES PATENT OFFICE

CERTIFICATE OF CORRECTION

PATENT NO. : 3,998,197

DATED : December 21, 1976

INVENTOR(S) : Mitsuo Katsumata

It is certified that error appears in the above-identified patent and that said Letters Patent are hereby corrected as shown below:

Title page, item [30], "Feb. 11, 1973" should read --Nov. 2, 1973--

Signed and Sealed this

Seventh Day of June 1977

[SEAL]

*Attest:*

RUTH C. MASON
*Attesting Officer*

C. MARSHALL DANN
*Commissioner of Patents and Trademarks*